US006459798B1

(12) United States Patent
Paritsky et al.

(10) Patent No.: US 6,459,798 B1
(45) Date of Patent: Oct. 1, 2002

(54) SOUND-COLLECTING DEVICE

(75) Inventors: Alexander Paritsky, Modiin (IL); Alexander Kots, Ashdod (IL); Okihiro Kobayashi, Tokyo (JP); Nobuhiro Miyahara, Tokyo (JP)

(73) Assignee: Phone-Or Ltd., Or-Yehuda (IL)

( * ) Notice: Subject to any disclaimer, the term of this patent is extended or adjusted under 35 U.S.C. 154(b) by 0 days.

(21) Appl. No.: 09/881,830

(22) Filed: Jun. 15, 2001

(51) Int. Cl.[7] ..... H04R 25/00

(52) U.S. Cl. ..... 381/172; 381/92; 381/170; 359/149

(58) Field of Search ..... 381/170, 172, 381/91, 92, 93, 83, 122, 356, 358; 359/149, 150

(56) References Cited

U.S. PATENT DOCUMENTS 3,622,791 A * 11/1971 Bernard ..... 381/172

FOREIGN PATENT DOCUMENTS

JP 6-125599 5/1994
JP 6-165286 6/1994
JP 9-149490 6/1997

* cited by examiner

*Primary Examiner*—Huyen Le
(74) *Attorney, Agent, or Firm*—Townsend and Townsend and Crew LLP

(57) ABSTRACT

A device for collecting sounds from objects comprises a plurality of microphones whose directivity can be varied depending on the environment in which each object is located. An optical microphone includes a vibration board (2) which vibrates by sound pressure, a light source (3) for emitting a light beam to the vibration board (2), a photodetector (5) which receives the light beam reflected from the vibration board (2) and produces a signal corresponding to the vibration of the vibration board (2), a drive circuit (13) for supplying the light source (3) with predetermined current, and a negative feedback circuit (100) that supplies the drive circuit (13) with a negative feedback signal consisting of a signal output from the photodetector (5). The negative feedback circuit (100) changes the amount of negative feedback depending on the environment.

3 Claims, 5 Drawing Sheets

SOUND-COLLECTING DEVICE

CROSS-REFERENCES TO RELATED APPLICATIONS

International Publication No.: WO 01/28284

International Application No.: PCT/JP00/07169 Oct. 16, 2000

International Application Date: Oct. 16, 2000

Priority No.: Japanese Patent Application No. 11-294223

Priority Date: Oct. 15, 1999 Oct. 15, 1999 JP

BACKGROUND OF THE INVENTION

1. Technical Field

This invention relates in a sound collector, and it is related to the sound collector that the most suitable microphone characteristics are set up corresponding to the use environment.

2. Description of the Related Art

So far, accessory microphone to choose to have the most suitable microphone characteristics corresponding to the use and the sound collection object is known. The types of such accessory microphone include a desktop type, a built-in type, a hand type, and so on. Functionally, a non-directional type and a single directive type are known. Also, a microphone that may be switched between a standard microphone and a long distance microphone is known. In view of the form of microphone, a vocal type, a stand table type and a clip type are known. Various microphones stated above have been used corresponding to the feature and usage as conventional accessory microphones.

However, the above-mentioned conventional accessory microphones were not suitable for collecting sound from the specific direction. This is because the conventional accessory microphones could not limit directivity on the beam toward the sound collection object. Further, it wasn't possible to change a use of microphone that was used for a specific use. For example, when a microphone used for conferencing was put in the open air, it was a problem that an ambient noise was taken and that aural recording wasn't done well. To dissolve the above-mentioned problem, it is an object of this invention to provide a sound collector that may change the characteristics of the microphone so that it may achieve the most suitable microphone characteristics corresponding to the use environment of the microphone.

BRIEF SUMMARY OF THE INVENTION

To solve the problem, a sound collector of this invention is collecting sound by changing directivities of microphone according to an environment in which a sound collection object is located; wherein the above microphone is an optical microphone that comprises a diaphragm to vibrate by the sound pressure; an illuminant to irradiate an optical beam to the above diaphragm; a photodetector which receives a reflection light of the light beam irradiated in the diaphragm and which outputs a signal which copes with the oscillation of the diaphragm; an illuminant drive circuit to drive the illuminant to supply predetermined electric current; and a negative feedback circuit that supplies the signal outputted by the optical detector to the illuminant drive circuit as a negative feedback signal; and wherein the gain of negative feedback of the negative feedback circuit is changed corresponding to the environment. Another sound collector of this invention further comprises means for distinguishing a spectrum of the voice from the sound collection object or the noise, wherein the environment in which the above sound collection object is located can be decided based on the recognition. Still another sound collector of this invention may execute the recognition of the spectrum at the arbitrary timing.

BRIEF DESCRIPTION OF THE DRAWINGS

FIG. 9(A)–(B) shows recognition fructification of an audio spectrum that this invention was used for.

DESCRIPTION OF THE SPECIFIC EMBODIMENTS

Figure 3:
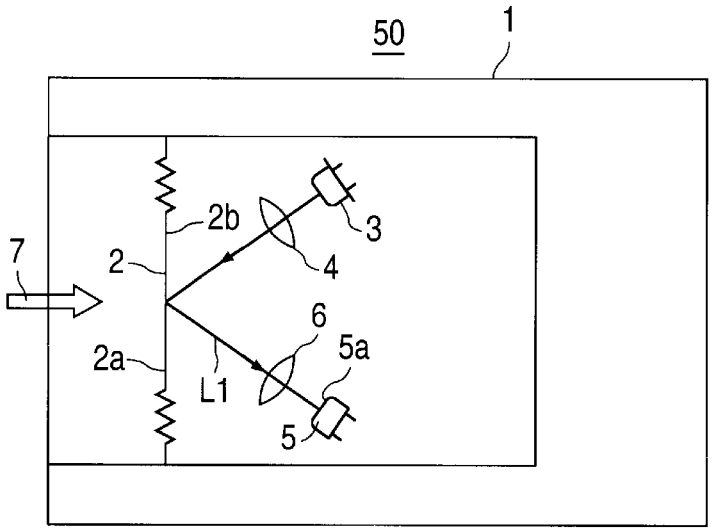
FIG. 3 shows a structure of an optical microphone element to use for this invention.

First, the fundamental principle of the optical microphone and its structure are explained below. FIG. 3 shows a structure of the head part of an optical microphone element 50. A diaphragm 2 which oscillates by a sound wave is provided in the microphone head 1, and a surface 2*a* at the side which a sound wave hits is exposed to the outside. Therefore, a sound wave 7 reaches this surface 2*a*, and oscillates this diaphragm 2. Inside the head 1 located in the opposite surface 2*b* of the diaphragm 2 against the surface 2*a*, a light source 3 such as LED irradiating a light beam in the surface 2*b* of the diaphragm 2, a lens 4 to make a light beam from this light source 3 predetermined beam shape, a photodetector 5 which receives the reflection light reflected in the surface 2*b*, and a lens 6 to zoom the displacement of the optical path of the reflection light caused by the oscillation of the diaphragm 2, are set up. When a sound wave 7 hits the surface 2*a* of the diaphragm 2 and a diaphragm 2 oscillates, the receiving position of the reflection light that enters to the receiving surface 5*a* of the photodetector 5 changes.

If a photodetector 5 is composed as a position sensor, an electric signal which met the oscillation of the diaphragm 2 from the irradiation location of the reflection light is taken out. This is the basic structure of the optical microphone. However, effect on a noise decrease can't be expected with the optical microphone that shows it in the FIG. 3 very much. This is because a diaphragm 2 also oscillates by the noise which reaches a diaphragm 2 and this is piled as a noise signal by oscillation by the usual sound wave 7.

Figure 4:
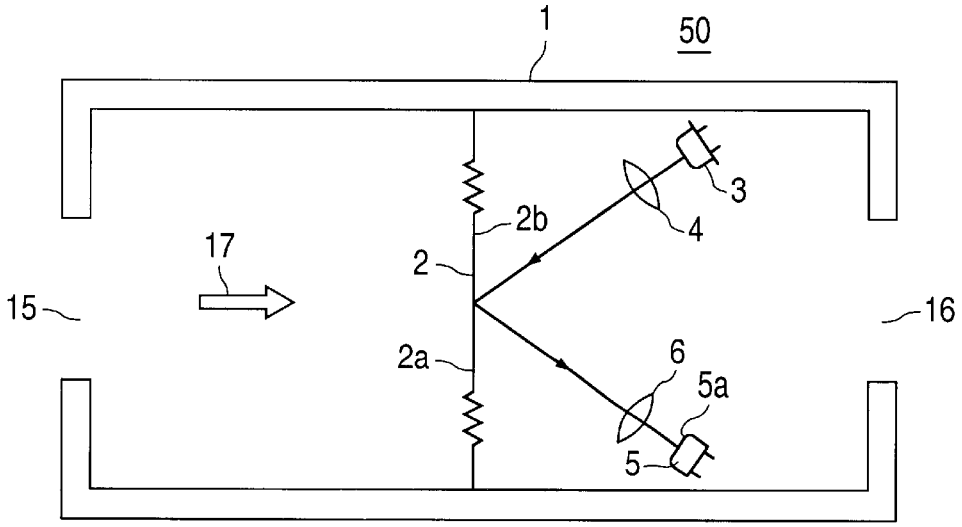
FIG. 4 shows a structure of another optical microphone element used for this invention.

As an optical microphone which reduces the influence of this noise and attempts effect on a noise decrease, a structure shown in FIG. 4 is known. In the structure shown in FIG. 4, the diaphragm 2, which oscillates by the sound wave 7, is provided in almost the center of the head 1. Then, on both sides of the head 1, a 1st opening 15 and a 2nd opening 16 are set up to become symmetrical location to each other. By composing it like this, a sound wave gets into the head 1 from the both openings to oscillate the diaphragm 2.

In the optical microphone element 50 shown in FIG. 4, when the phase and the amplitude of the sound wave from the 1st opening 15 and those of the sound wave from the 2nd opening 16 are equal, these two sound waves interfere with each other in both sides 2*a* and 2*b* of the diaphragm 2, and never oscillate the diaphragm 2. When two microphones that have equal sensitivities are arranged lose and they receive the sound wave which occurred in the far range, the two microphone elements detect the sound wave equally.

Generally, a sound wave occurs from the mouth of the person in the short distance to the microphone element. In other words, most voice occurs at the short distance from this microphone element. The voice of the person of this short distance has globular field characteristics so that it may be shown by a circular curve. As for the sound wave by the noise sound which occurs in the far range has the characteristics of the plane field. Though the sound intensity of the globular wave is about the same along that spherical surface or the envelope and changes along the radius of that glob, sound intensity of the plane wave almost becomes the same in all the plane points.

As the optical microphone element shown in FIG. 4 can be thought to associate two microphone element, when this was put on the far range field, the sound waves which have almost the same amplitude and phase characteristics from the 1st opening 15 and the 2nd opening 16 comes in the diaphragm 2 to interfere with each other, and those influences are decreased. On the other hand, as a sound wave from the short distance field enters from the 1st opening 15 or the 2nd opening 16 non-uniformly, a sound wave from the short distance field oscillates a diaphragm 2, and it is taken out as a signal by the photodetector 5. The structure of FIG. 4 can provide the optical microphone element which reduces the influence of the noise more.

Figure 7:
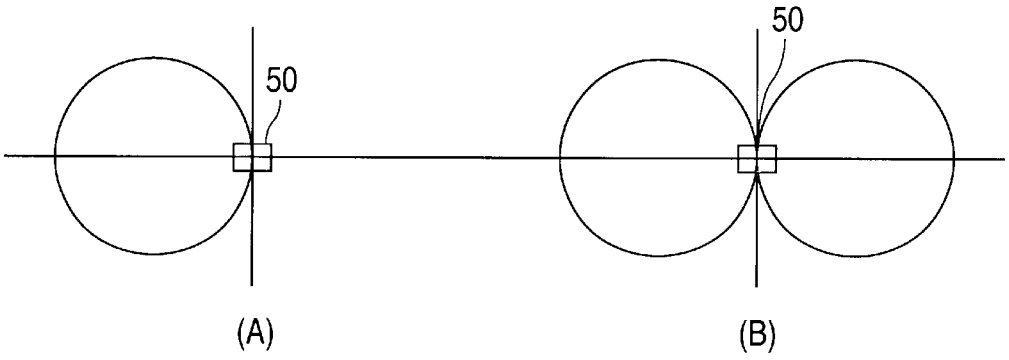
FIG. 7(A)–(B) shows directional characteristics pattern figure of an optical microphone element used for this invention.

FIG. 7 shows directivity response patterns of the optical microphone element shown in FIG. 3 and FIG. 4. FIG. 7A shows a directivity response pattern of the optical microphone element 50 shown in FIG. 3. This optical microphone element 50 has an almost circular-shaped directivity response pattern, and has optimum sensitivity in the direction which is vertical to the diaphragm 2 toward the opening (the left side direction of the figure). FIG. 7B shows a directivity response pattern of the optical microphone element 50 shown in FIG. 4. This optical microphone element 50 has almost "8" shaped directivity response pattern, and has optimum sensitivity in both directions of the openings 15 and 16.

Figure 2:
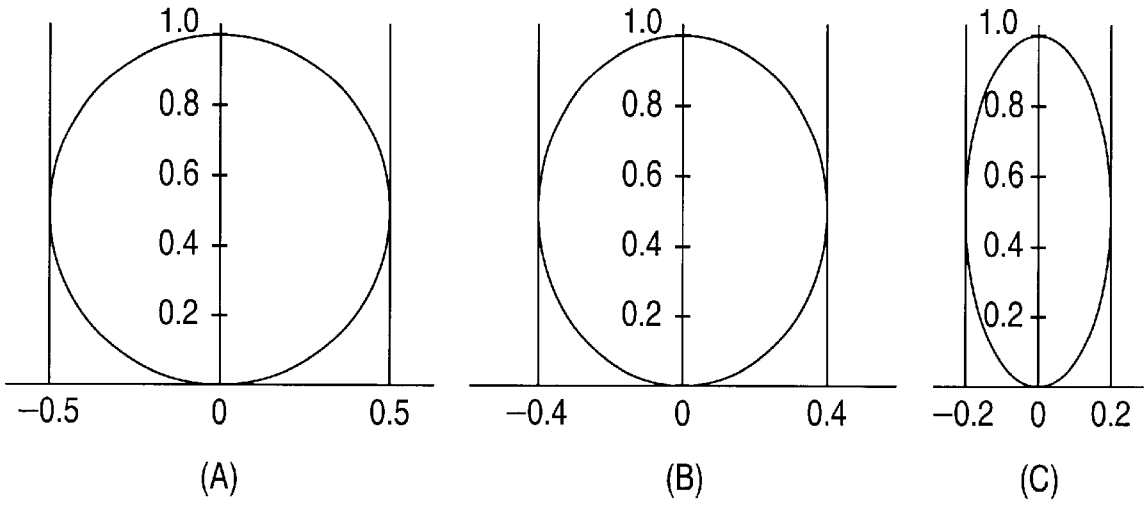
FIG. 2(A)–(C) shows a gradation of a directivity response pattern of an optical microphone element to use for this invention.
Figure 5:
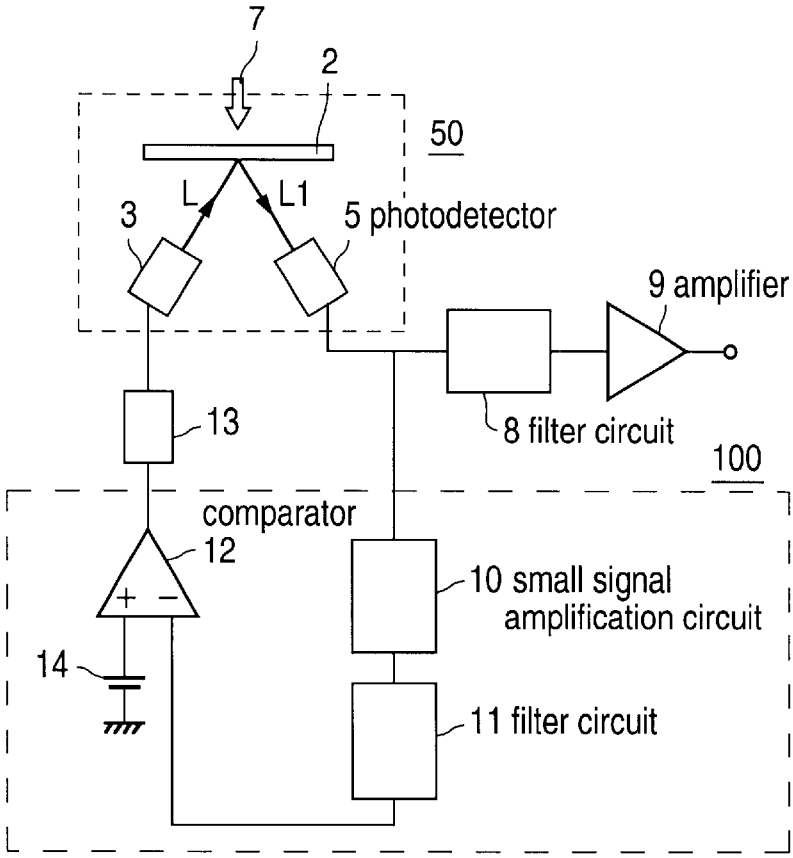
FIG. 5 shows a circuit diagram that shows an outline configuration of an optical microphone device to use for this invention.
Figure 6:
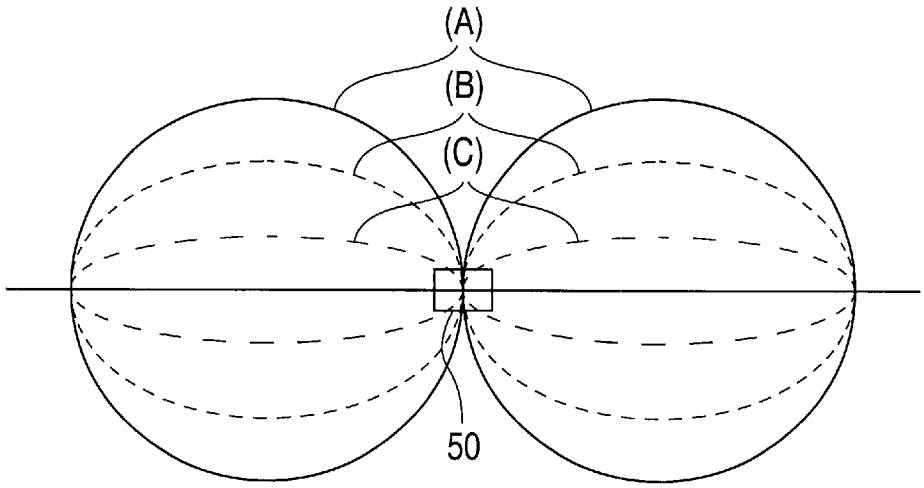
FIG. 6 shows a gradation figure of a directivity response pattern of the optical microphone element of the FIG. 4.

The directivity response pattern of the optical microphone element 50 shown in FIG. 3 and FIG. 4 can be stretched along the axis having optimum sensitivity as shown in FIG. 2 or FIG. 6. Also, the directivity response pattern can be narrowed along the direction which is vertical to the axis. To make the pattern of the directivity change like this, a part of the detection output from the photodetector 5 should be negatively feedbacked by using the negative feedback circuit to the light source drive circuit that drives light source 3. FIG. 5 shows an outline configuration of an optical microphone device which used a feedback circuit 100 to make a beam pattern change such as FIG. 2 or FIG. 6.

Output from the photodetector 5 is taken out through the filter circuit 8, amplified by an amplifier 9, and it becomes microphone output. A filter circuit 8 is used to take out a requested signal component of the frequency range. Here, with the optical microphone device shown in FIG. 5, it is composed to supply a part of the output signal taken out from this photodetector 5 to the light source drive circuit 13 through the negative feedback (NFB) circuit 100 as a negative feedback signal. Light source drive circuit 13 drives this light source 3 by supplying predetermined electric current to the light source 3.

Negative feedback circuit 100 comprises a small signal amplification circuit 10, a filter circuit 11 which takes out a signal component of the requested frequency range from the output from the small signal amplification circuit 10, and a comparator 12. A norm power source 14 which provides reference voltage is connected to the non-inversion input terminal of the comparator 12. The signal taken out through the filter circuit 11 is supplied to the reverse input terminal of the comparator 12. When it is composed like this, a little output level is outputted as much as the output of the filter circuit 11 of the comparator 12 is big, and light source drive circuit 13 is actuated by this to reduce electric current supplied to the light source 3.

Only when an input signal level is less than a predetermined level, small signal amplification circuit 10 amplifies that signal, and a certain signal beyond the level is not amplified. Therefore, an output signal level doesn't change in the case the input signal level is beyond a predetermined level, and amplification degree (gain) becomes 0. When an input signal is less than a predetermined signal level, it amplifies so that amplification degree may grow big as much as a signal level is small. Furthermore, the rate of increase of the output signal toward the input signal rises as much as an input signal level is small. As an output from the photodetector 5 is in proportion to the received sound volume, the output of the small signal amplification circuit 10 is greatly amplified and outputted.

Because this output is being inputted to the reverse input terminal of the comparator 12 through the filter circuit 11, the output of the comparator 12 decreases conversely as much as small sound volume. As that result, the electric current supplied to the light source 3 is actuated so that small sound volume may make the optical output of the light source 3 decline. Id est, the sensitivity of the microphone declines as much as small sound volume. As a signal beyond the predetermined level isn't amplified, optical output isn't restricted by that signal level. Therefore the sensitivity of the microphone never declines.

When the sound which came from the axis direction which was vertical to the diaphragm and which has a volume that does not cause the sensitivity decline of the microphone is moved from the axis direction, sensitivity gradually declines along the original directivity response pattern curve. Then, when the sensitivity becomes less than a certain level, small signal amplification circuit 10 comes to have amplification degree, and the electric current control of the light source drive circuit 13 works, and the sensitivity of the microphone declines more. As this result, with the optical microphone device which has negative feedback circuit 100, the width of the directivity beam is more limited than the directivity response pattern of the sensitivity as shown in FIG. 2 and FIG. 6.

FIG. 2 and FIG. 6 show pattern gradations of directivity by changing the gain of negative feedback. In these figures, (A) shows the directivity response pattern when negative feedback isn't made, and almost becomes a circular directivity response pattern in this case. Next, directivity response patterns under negative feedback are shown in (B) and (C). The gain of negative feedback is small in the case of (B), and the gain of negative feedback is big in the case of (C). As shown in these FIGS., the gain of negative feedback is made to change by varying the amplification degree of the small signal amplification circuit 10. The directivity response pattern of the sensitivity can be stretched along the axis direction of the optimum sensitivity by this, or narrowed in the direction that is vertical to the axis. Thus, the directional characteristics of the sensitivity of the optical microphone can be changed.

Figure 1:
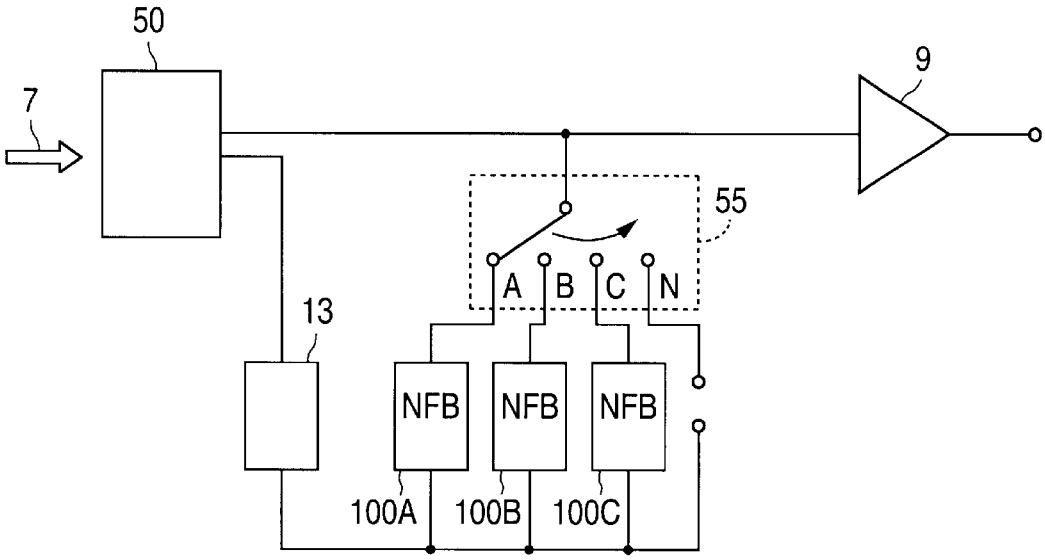
FIG. 1 shows a block diagram that shows a point part configuration of a sound collector of this invention.

The sound collector of this invention changes the directional characteristics of a selected microphone by using the optical microphone that may change the beam pattern of directivity. FIG. 1 shows a point part configuration of the sound collector of an embodiment of this invention. A sound collector of this invention uses an optical microphone. A detection signal from the optical microphone element 50 is taken out through the amplifier 9, and it becomes an aural signal. A part of the detection signal taken out from this optical microphone element 50 is introduced to the negative feedback circuits 100A, 100B, 100C which have a different gain of negative feedback through the selector switch 55. The detection signal is negatively feedbacked to light source drive circuit 13 through the negative feedback circuit 100A, 100B, or 100C. Light source drive circuit 13 drives optical microphone element 50.

Therefore, by changing the contact point of the selector switch 55, predetermined negative feedback circuit is chosen and different gain of negative feedback is put on the light source drive circuit 13. Along with the above, beam patterns which shows the directivity of the sensitivity of the optical microphone element 50 are changed as shown in FIG. 2 or FIG. 6. Therefore, changing the position A, B, C, N of the selector switch 55 may provide the most suitable beam pattern corresponding to the use environment.

In an embodiment shown in FIG. 1, a gain of negative feedback is the smallest in the switching position A of the selector switch 55, and a beam pattern is almost the circular. In the position B, the beam pattern becomes the middle degree, and in the position C, the beam pattern becomes the thinnest. In the position N, negative feedback is not performed. Therefore, by changing the selector switch 55 according to an environment of use of the sound collector so that it may achieve the most suitable characteristics. In other words, when it is used for conferencing in the conference room, the switch is changed to the position B, and a beam pattern is narrowed to the middle degree. Moreover, when it is used in the open air to collect sound from the distant, the switch is changed to the position C, and a beam pattern is narrowed most so that voice from the distance may be taken in good sensitivity.

Figure 10:
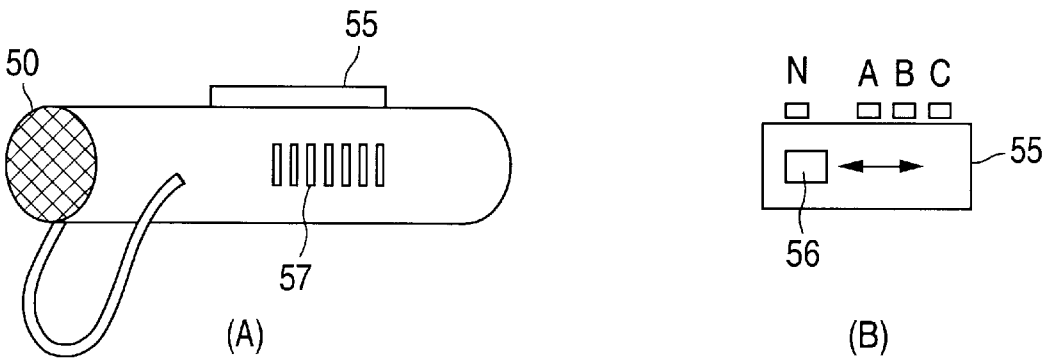
FIG. 10(A)–(B) shows an appearance configuration of the sound collector of this invention. In these FIGS., 2 is diaphragm, 3 is light source, 5 is photodetector, 7 is sound wave, 13 is light source drive circuit, 50 is optical microphone element, 55 is selector switch, 61 is low-pass filter, 62 is band path filter, 63 is high-pass filter, 64 is microcomputer, 100 is negative feedback circuit, and 100*a*–100*c* is negative feedback circuit.

FIG. 10 shows an appearance configuration of the sound collector of this invention. As shown in FIG. 10A, a back hole 57 is provided to take sound from behind the optical microphone element 50 and the optical microphone element shown in FIG. 4 is used. In this configuration, surroundings noise from the distance can be restrained exactly. A selector switch 55 can comprise slider 56 that slides multiple position as shown in figure 10B. Although the embodiment shown in FIG. 1 is composed to change a selector switch 55 by the manual operation, this switching isn't necessarily limited to this.

Figure 8:
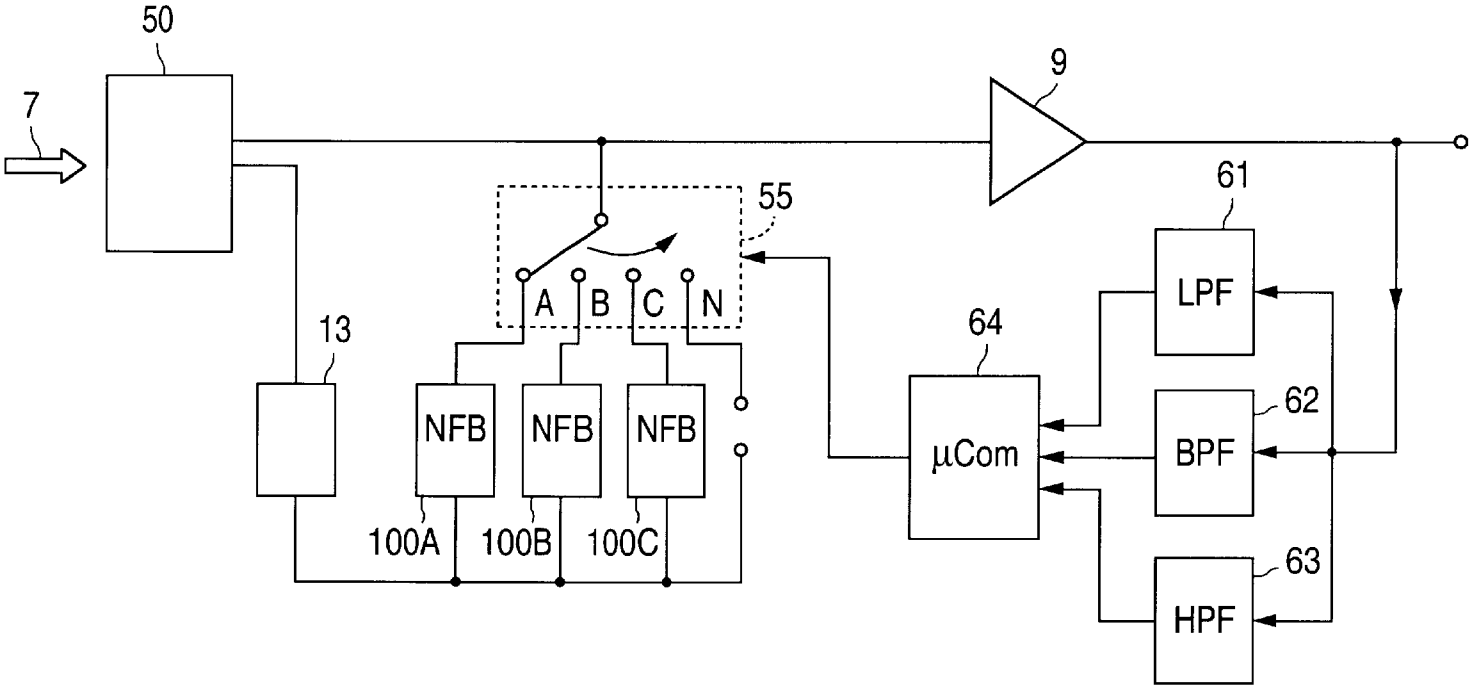
FIG. 8 shows a block diagram that shows a point part configuration of still another embodiment of this invention.

In another embodiment shown in FIG. 8, switching of this selector switch 55 is performed automatically. In other words, the embodiment shown in FIG. 8 detects each frequency spectrum of the audio output signal through a low-pass filter 61, a band path filter 62, and a high-pass filter 63. The detected frequency spectrum is analyzed by the microcomputer 64, and the use environment of the microphone is recognized from the frequency spectrum. Based on this recognition, switching of the selector switch 55 is performed to the most suitable position. In each of the filter 61–63, the spectrum of low voice, middle voice and high voice is extracted and analyzed by the microcomputer 64.

Figure 9:
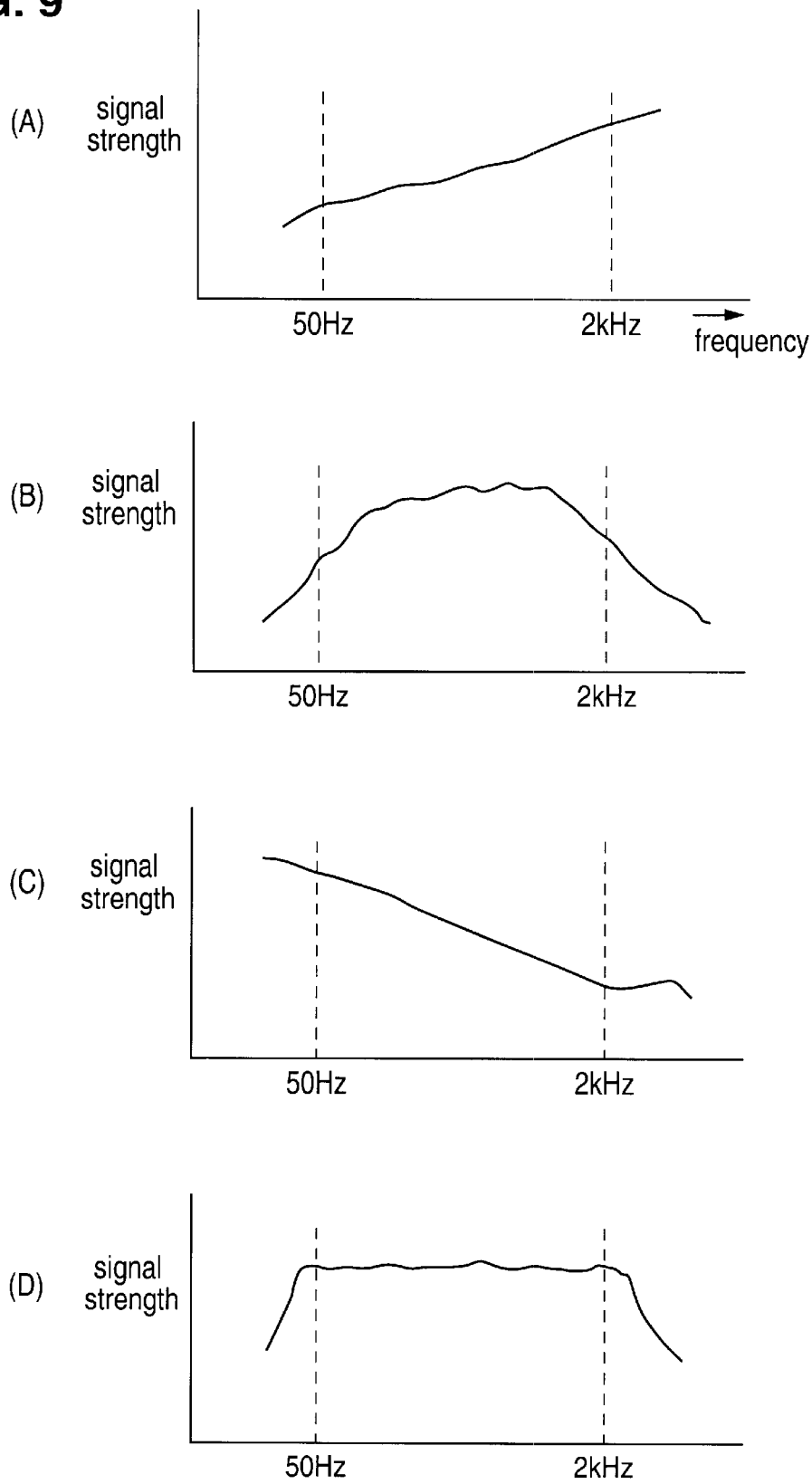

FIG. 9 shows a frequency characteristic from the various environments detected by a microcomputer 64 from the frequency spectrum detected by the filter 61–63. In an environment in FIG. 9A, signal strength in the low frequency region is weak, and as the frequency becomes high, signal strength becomes strong. In an environment in FIG. 9B, the signal strength is highest in the middle frequency. In an environment in FIG. 9C, signal is strong in the low frequency, and signal is weak in the high frequency. In an environment in FIG. 9D, signal strength is flat regardless of the frequency.

When such a frequency spectrum could be obtained by the microcomputer 64, switching of the selector switch 55 is done automatically according to the spectrum. In other words, the switch is changed to the position C to limit a directivity beam to the max and to increase sensitivity from the sound direction when a spectrum such as FIG. 9A or FIG. 9C is obtained. Position B is chosen when the spectrum shown in FIG. 9B is obtained. Position N is chosen when the spectrum shown in FIG. 9D is obtained. The position N shows a usual usage of the microphone and the position N is used in the situation that there is no need to narrow the beam pattern of the directivity. Therefore, negative feedback circuit isn't used or the actuation of the negative feedback circuit is suspended in this case.

As explained above, with the sound collector of this invention, optical microphone can be changed by using the selector switch selecting characteristics to achieve the most suitable microphone characteristics corresponding to the environment which a sound collection object is located in. Therefore, collecting sound that decreased the noise of the surroundings becomes possible. The noise decrease level that 5–8 dB was a limit in usual was reduced to more than 20 dB in the sound collector of this invention.

What is claimed is:

1. A sound collector collecting sound by changing directivities of a microphone according to an environment in which a sound collection object is located;

wherein the above microphone is an optical microphone that comprises a diaphragm to vibrate by the sound pressure;

an illuminant to irradiate an optical beam to the above diaphragm;

a photodetector which receives a reflection light of the light beam irradiated in the diaphragm and which outputs a signal which copes with the oscillation of the diaphragm;

an illuminant drive circuit to drive the illuminant to supply predetermined electric current; and a negative feedback circuit that supplies the signal outputted by the photodetector to the illuminant drive circuit as a negative feedback signal; and wherein the gain of negative feedback of the negative feedback circuit is changed corresponding to the environment.

2. The sound collector according to claim 1 further comprises means for distinguishing a spectrum of the voice from the sound collection object or the noise, wherein the environment in which the above sound collection object is located can be decided based on the recognition.

3. The sound collector according to claim 2, wherein the recognition of the spectrum may be executed at the arbitrary timing.

* * * * *